US012642380B2

(12) United States Patent
Collier

(10) Patent No.: US 12,642,380 B2
(45) Date of Patent: Jun. 2, 2026

(54) PNEUMATIC COMPRESSION STOCKING DONNER

(71) Applicant: United States Government As Represented By The Department Of Veterans Affairs, Washington, DC (US)

(72) Inventor: Joshua Collier, Washington, DC (US)

(73) Assignee: United States Government as represented by the Department of Veterans Affairs, Washington, DC (US)

( * ) Notice: Subject to any disclaimer, the term of this patent is extended or adjusted under 35 U.S.C. 154(b) by 0 days.

(21) Appl. No.: 19/044,568

(22) Filed: Feb. 3, 2025

(65) Prior Publication Data

US 2025/0248552 A1 Aug. 7, 2025

Related U.S. Application Data

(60) Provisional application No. 63/549,483, filed on Feb. 3, 2024.

(51) Int. Cl.
*A47G 25/90* (2006.01)

(52) U.S. Cl.
CPC ..... *A47G 25/905* (2013.01)

(58) Field of Classification Search
CPC ..... A47G 25/90; A47G 25/905
See application file for complete search history.

(56) References Cited

U.S. PATENT DOCUMENTS

| | | | | |
|---|---|---|---|---|
| 2005/0087573 | A1* | 4/2005 | Unsworth | A47G 25/904 223/112 |
| 2007/0119882 | A1* | 5/2007 | Scott | A47G 25/907 223/111 |
| 2009/0120975 | A1* | 5/2009 | Schoepe | A47G 25/905 223/111 |
| 2011/0139835 | A1* | 6/2011 | Fikes | A47G 25/905 223/111 |

FOREIGN PATENT DOCUMENTS

| | | | | |
|---|---|---|---|---|
| CA | 2756702 | A1 * | 4/2013 | A47G 25/905 |
| DE | 202022001458 | U1 * | 7/2022 | A47G 25/905 |
| EP | 2641513 | A1 * | 9/2013 | A47G 25/908 |
| EP | 3892165 | A1 * | 10/2021 | A47G 25/905 |
| WO | WO-2021221494 | A1 * | 11/2021 | A47G 25/905 |

OTHER PUBLICATIONS

Translation DE 202022001458.*
Translation EP 3892165.*

* cited by examiner

*Primary Examiner* — Shaun R Hurley
(74) *Attorney, Agent, or Firm* — Ballard Spahr LLP

(57) ABSTRACT

An apparatus for donning a compression garment includes a base having a platform extending along a longitudinal axis. A bladder has a wall defining an inner surface and an outer surface. The inner surface defines an interior volume. The wall is folded upon itself along a rolled end so that a first portion of the wall is surrounded by a second portion of the wall. An inlet port is in fluid communication with the interior volume of the bladder. The outer surface of the first portion (Continued)

of the wall defines a receiving space positioned within and surrounded by the outer surface of the first portion. At least a portion of the bladder is movable relative to the platform to permit the rolled end to change position along the wall of the bladder.

20 Claims, 8 Drawing Sheets

PNEUMATIC COMPRESSION STOCKING DONNER

CROSS-REFERENCE TO RELATED APPLICATIONS

This application claims priority to and the benefit of the filing date of U.S. Provisional Patent Application No. 63/549,483, filed Feb. 3, 2024, the entirety of which is incorporated by reference herein.

FIELD

This disclosure relates to systems and methods for donning compression garments, and, in particular, to donning compression garments using a pneumatic air source.

BACKGROUND

Compression garments (e.g., compression stockings) are often used as a treatment for many medical diagnoses, preventive treatments, post-surgery care, wound healing, and common ailments. Some medical issues typically require compression therapy for treatment or preventive treatment such as; congestive heart failure, lymphedema, deep vein thrombosis, and dependent edema. These medical issues are dependent on compression therapy as the treatment and for prolonged maintenance of health. For example, the only treatment for lymphedema involves compression garments. These compression garments are carefully measured and are required to be worn every day. Compression is often measured in millimeters of mercury (mmHg) and can range from light elastic compression (8-15 mmHg) to heavy compression (25-35 mmHg). Common difficulties with using compression garments relate to being able to get the medical compression garment on and off, referred to respectively as "donning" and "doffing." These difficulties range from lack of range of motion to reach the lower foot, to having poor grip strength and pull strength to get the compression garment on.

Current Compression Donners

Current compression donners on the market are manual devices that require some combination of grip strength, range of motion (reach), and/or pulling strength to don the compression garment. However, many people whose health medically depends on compression do not have the strength or reach necessary to complete the donning task even with conventional compression donners. This leaves such people with two options: become reliant on caregivers to assist them with donning and doffing their compression stockings; or become non-compliant with their medical treatment. There are currently no automatic compression donners.

The following are examples of designs used in healthcare:

Basic Rigid Sock Aids: Although these devices include multipole variations, all operate in the same manner. A compression stocking is stretched over a rigid U-shaped trough, and the stocking is pulled over the leg using string handles. One problem with these devices is that they requires grip strength, coordination, and pull strength to don the stocking. Further, these devices do not typically work with medium or heavy compression stockings.

Medium-Heavy Compression Rigid Donner: Each of these devices relies on the ability to stretch the compression stocking over a device that is larger than the actual leg and then pull the device up the leg using handles. These devices require a great amount of grip strength, pull strength, coordination, and a sequence of tasks to pull over leg.

Basic flexible Sock Aids: All variations of this device are similarly operated by placing the sock over the device and pulling with a string handle. One problem with this device is that it can work only with basic socks and does not work with any compression level, due to the device having a flexibility that collapses under a compression garment.

SUMMARY

Disclosed herein is an apparatus for donning a compression garment includes a base having a platform extending along a longitudinal axis. A bladder has a wall defining an inner surface and an outer surface. The inner surface defines an interior volume. The wall is folded upon itself along a rolled end so that a first portion of the wall is surrounded by a second portion of the wall. An inlet port in fluid communication with the interior volume of the bladder. The outer surface of the first portion of the wall defines a receiving space positioned within and surrounded by the outer surface of the first portion. At least a portion of the bladder is movable relative to the platform to permit the rolled end to change position along the wall of the bladder.

Also disclosed herein is a system comprising the apparatus and a compressed air source in fluid communication with the inlet port of the apparatus.

Also disclosed herein is a method of using the apparatus. The method includes the steps of inserting a first portion of a compression garment into the receiving space defined by the outer surface of the first portion of the wall; folding the compression garment outwardly around the rolled end of the bladder so that a second portion of the compression garment; inserting an appendage into the first portion of the compression garment; and inflating the bladder.

BRIEF DESCRIPTION OF THE DRAWINGS

The accompanying drawings, which are incorporated in and constitute a part of this specification, illustrate several embodiments of the disclosed apparatus, system, and method and together with the description, serve to explain the principles of the disclosed apparatus, system, and method.

DETAILED DESCRIPTION

Figure 1:
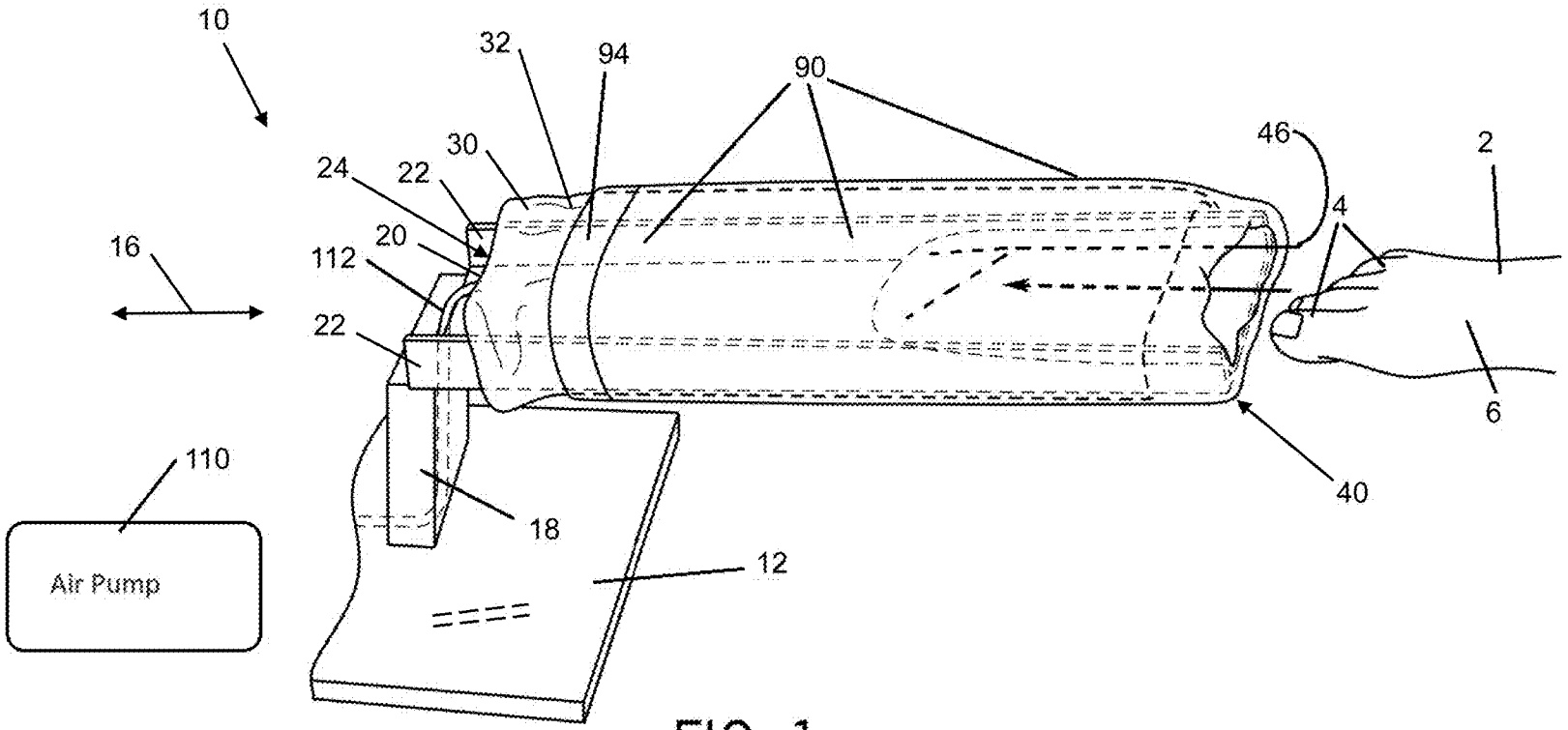
FIG. 1 is a perspective view of a system comprising an apparatus for donning a compression garment (stocking) as disclosed herein.

The disclosed system and method may be understood more readily by reference to the following detailed description of particular embodiments and the examples included therein and to the Figures and their previous and following description.

It is to be understood that the terminology used herein is for the purpose of describing particular embodiments only and is not intended to limit the scope of the present invention which will be limited only by the appended claims.

It must be noted that as used herein and in the appended claims, the singular forms "a," "an," and "the" can include plural references unless the context clearly dictates otherwise. Thus, for example, reference to "a material" amounts to a disclosure of embodiments in which only a single material is provided, as well as embodiments in which a plurality of such materials are provided.

"Optional" or "optionally" means that the subsequently described event, circumstance, or material may or may not occur or be present, and that the description includes instances where the event, circumstance, or material occurs or is present and instances where it does not occur or is not present.

Ranges may be expressed herein as from "about" one particular value, and/or to "about" another particular value. When such a range is expressed, also specifically contemplated and considered disclosed is the range from the one particular value and/or to the other particular value unless the context specifically indicates otherwise. Similarly, when values are expressed as approximations, by use of the antecedent "about," it will be understood that the particular value forms another, specifically contemplated embodiment that should be considered disclosed unless the context specifically indicates otherwise. It will be further understood that the endpoints of each of the ranges are significant both in relation to the other endpoint, and independently of the other endpoint unless the context specifically indicates otherwise. Finally, it should be understood that all of the individual values and sub-ranges of values contained within an explicitly disclosed range are also specifically contemplated and should be considered disclosed unless the context specifically indicates otherwise. The foregoing applies regardless of whether in particular cases some or all of these embodiments are explicitly disclosed.

Optionally, in some aspects, when values or characteristics are approximated by use of the antecedents "about," "substantially," or "generally," it is contemplated that values within up to 15%, up to 10%, up to 5%, or up to 1% (above or below) of the particularly stated value or characteristic can be included within the scope of those aspects.

Unless defined otherwise, all technical and scientific terms used herein have the same meanings as commonly understood by one of skill in the art to which the disclosed apparatus, system, and method belong. Although any apparatus, systems, and methods and materials similar or equivalent to those described herein can be used in the practice or testing of the present apparatus, system, and method, the particularly useful methods, devices, systems, and materials are as described.

Throughout the description and claims of this specification, the word "comprise" and variations of the word, such as "comprising" and "comprises," means "including but not limited to," and is not intended to exclude, for example, other additives, components, integers or steps. In particular, in methods stated as comprising one or more steps or operations it is specifically contemplated that each step comprises what is listed (unless that step includes a limiting term such as "consisting of"), meaning that each step is not intended to exclude, for example, other additives, components, integers or steps that are not listed in the step.

Referring now to FIGS. 1-5 and 8, an apparatus 10 for donning a compression garment 90 is shown. The apparatus 10 can comprise a base 12 having a platform 14 extending along a longitudinal axis 16. The apparatus 10 can further comprise a bladder 30 having a wall 32 defining an inner surface 34 and an outer surface 36. The inner surface 34 can define an interior volume 38. The wall 32 can be folded upon itself along a rolled end 40 so that a first portion 42 of the wall 32 (the portion of the wall 32 that is folded inwardly into the interior volume 38) is surrounded by a second portion 44 of the wall 32. An inlet port 50 can be in fluid communication with the interior volume 38 of the bladder 30. The outer surface 36 of the first portion 42 of the wall 32 can define a receiving space 46 that is configured to receive a portion 92 of the garment 90. At least a portion of the bladder 30 is movable relative to the platform 14 to permit the rolled end 40 to change position along the wall 32 of the bladder 30.

In some aspects, the base 12 can further comprise a stand 18 that is configured to rest on a surface (e.g., a ground surface). The stand 18 can be coupled to the platform 14 so that the stand supports the platform 14 above the surface. In some aspects, the base 12 can be weighted to inhibit movement relative to the surface. In some aspects, the platform 14 can comprise an upper surface 20 and a pair of spaced longitudinally extending side walls 22 that define a channel 24 therebetween. The bladder 30 can surround the channel 24, and the platform 14 can support the bladder to hold the receiving space 46 sufficiently open to receive the portion of the garment 90 and a foot 2 of a user 1 therein.

Figure 8:
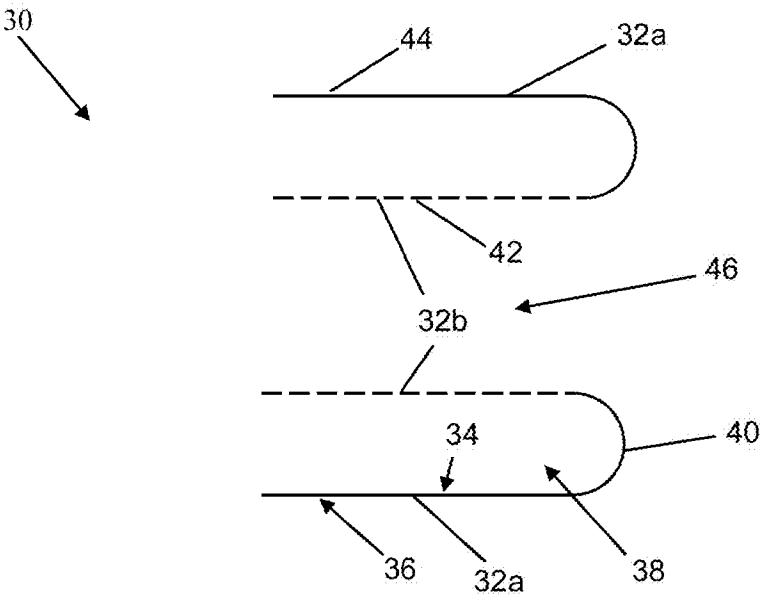
FIG. 8 is a cross-sectional view of a portion of the bladder that is configured to receive a user's foot therein.

In some aspects, and with reference to FIG. 8, at least a portion of the wall 32 of the bladder 30 can be configured to elongate. For example, a first section 32*a* of the wall 32 of the bladder 30 that forms the second portion 44 of the bladder can be configured to elongate, whereas a second section 32*b* of the wall of the bladder that forms the first portion 42 of the bladder 30 can be resistant to elongation. In this way, as the bladder 30 is inflated, the second section 32*b* can expand, while the first section 32*a* does not. In some optional aspects, because the first section 32*a* is not expanding, the rolled end can change position along the wall 32 of the bladder 30. This can push the garment 90 along the appendage of the user, rolling the garment along the appendage as the bladder expands.

In some aspects, the first section 32*a* of the wall 32 can comprise a first material that is configured for elastic elongation, and the second section 32*b* of the wall 32 can comprise a second material that is resistant to elongation. Optionally, said first material can be configured for elongation along only one axis. For example, the first material can comprise one-way stretch material. In some optional aspects, the second material that is resistant to elongation can be configured to stretch no more than 5%, or 4%, or 3%, or 2%, or 1% when a pressure of 35 mmHg is within the interior volume of the bladder. In exemplary aspects, the bladder 30 can comprise parachute cloth, rubber, nylon, or any other combination of elastic and/or rigid fabrics.

In additional aspects, a support structure can be attached to the bladder to selectively inhibit portions (e.g., some or all portions of the second section 32*b* of the wall 32) of the bladder from expanding. For example, a non-stretch material can be attached (e.g., optionally, sewn, adhered, or thermally bonded) to portion(s) of the bladder to inhibit elongation. For example, inelastic stitches can be provided in certain portions of the bladder. Optionally, the inelastic stitching can be provided in a pattern that promotes elongation of the bladder in a predetermined fashion. For example, optionally, the non-stretch material can be provided in a pattern of scalene triangles. An acute scalene triangle pattern sewn into the bladder can cause the bladder to increase in diameter by inflation to at different rate around the area applied, as compared to areas without the acute scalene triangle. Accordingly, such a pattern can be used to translate the horizontal inflation force to a vertical inflation force. In additional aspects, non-stretch bands can be coupled to one or more portions of the bladder to inhibit elongation of said one or more portions. The non-stretch bands can comprise, for example, metal or polymer. Optionally, said non-stretch bands can be rigid. In other aspects, the non-stretch bands can be flexible. In some aspects, a non-inflatable band can span across the bladder to inhibit inflation of the bladder beyond a specific diameter in the area applied. This can prevent the stocking from rolling on the bladder instead of rolling onto the foot. An all encapsulating non stretch cylinder over the hollow cylinder bladder can direct all or substantially all the inflation force forward until the bladder inflates past the end of the encapsulating non stretch portion of the bladder, thereby exposing the more elastic hollow cylinder bladder.

Figure 3:
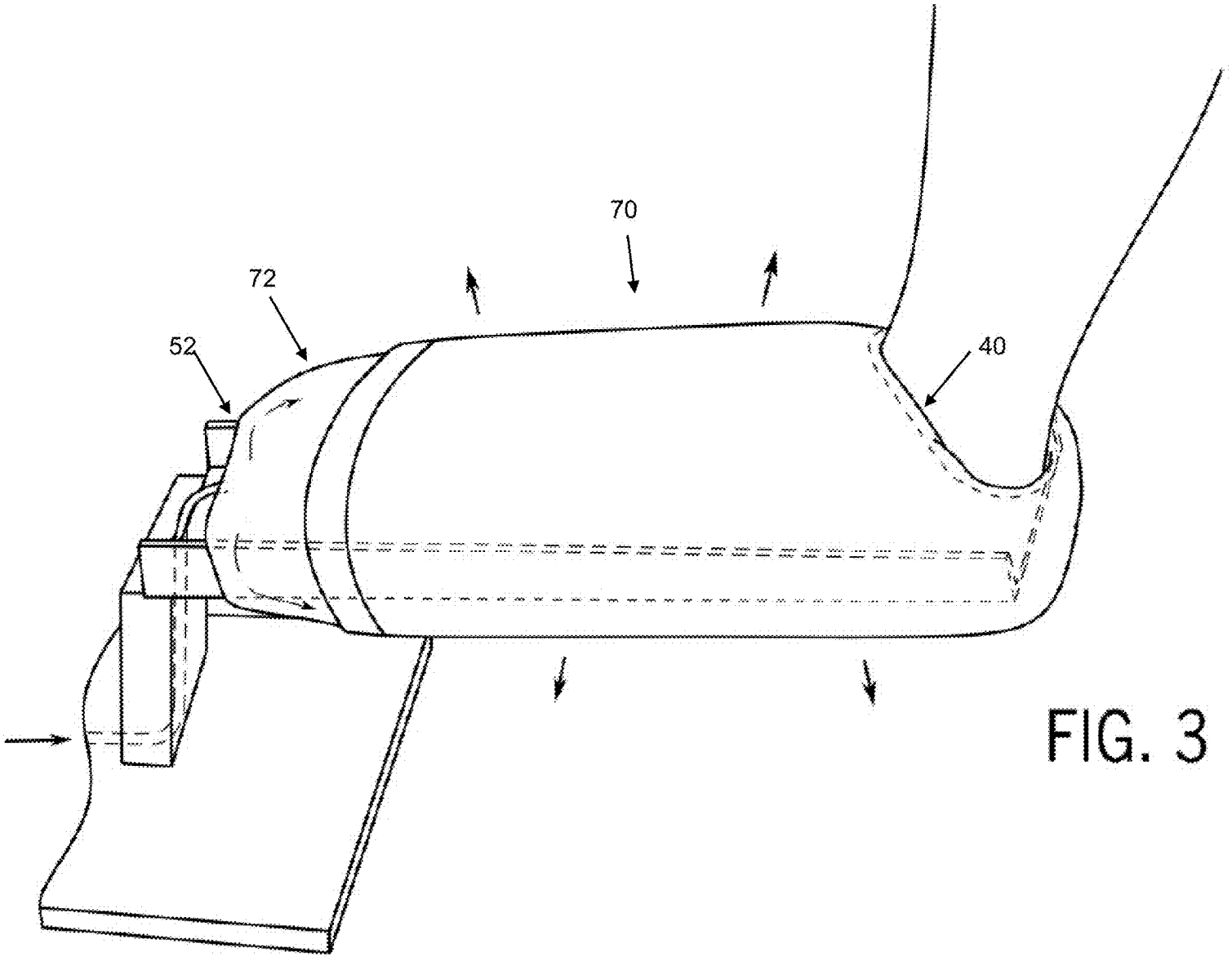
FIG. 3 is a perspective view of the apparatus, as a bladder of the apparatus is initially inflated.
Figure 4:
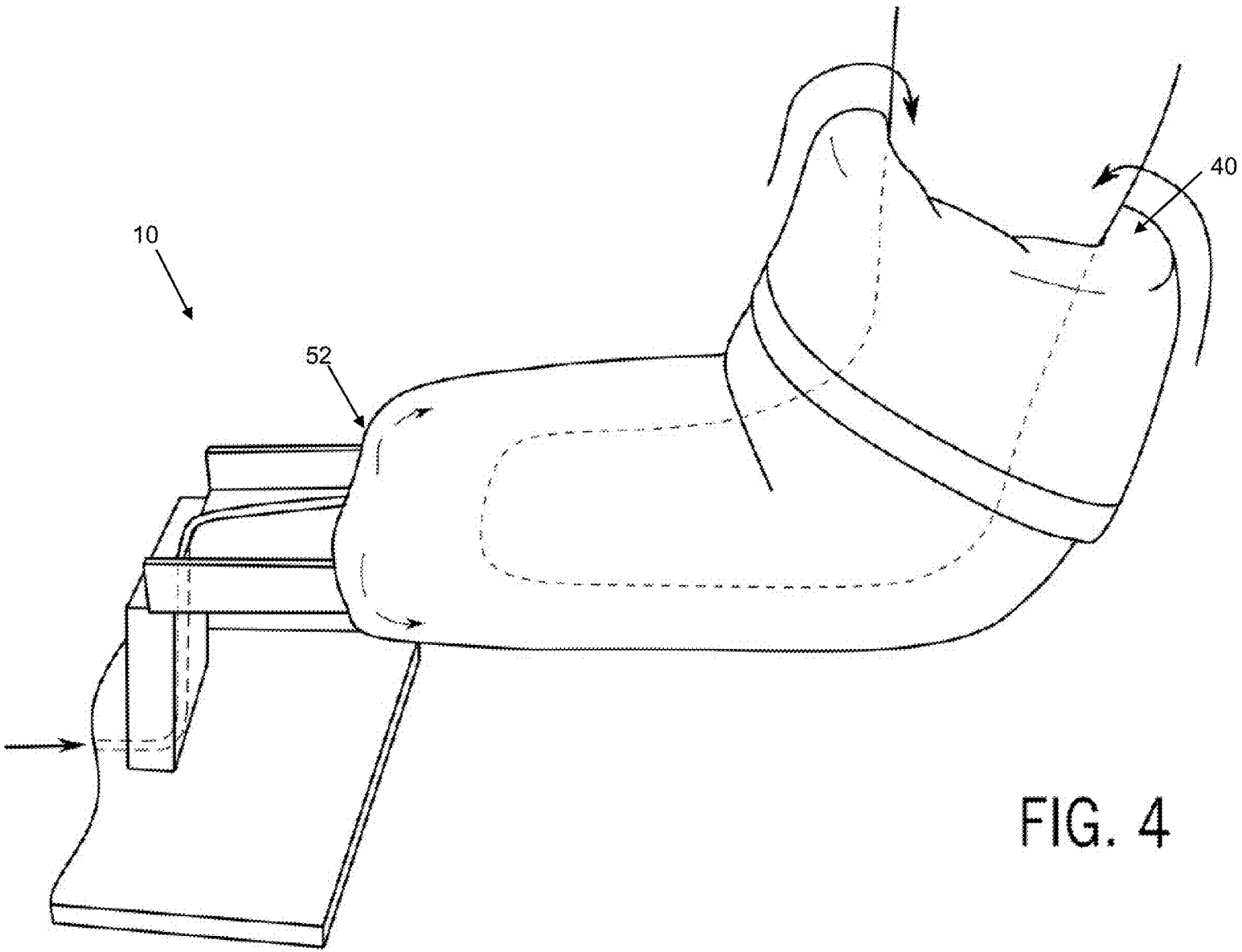
FIG. 4 is a perspective view of the apparatus as the bladder expands and rolls from a platform of the apparatus.
Figure 5:
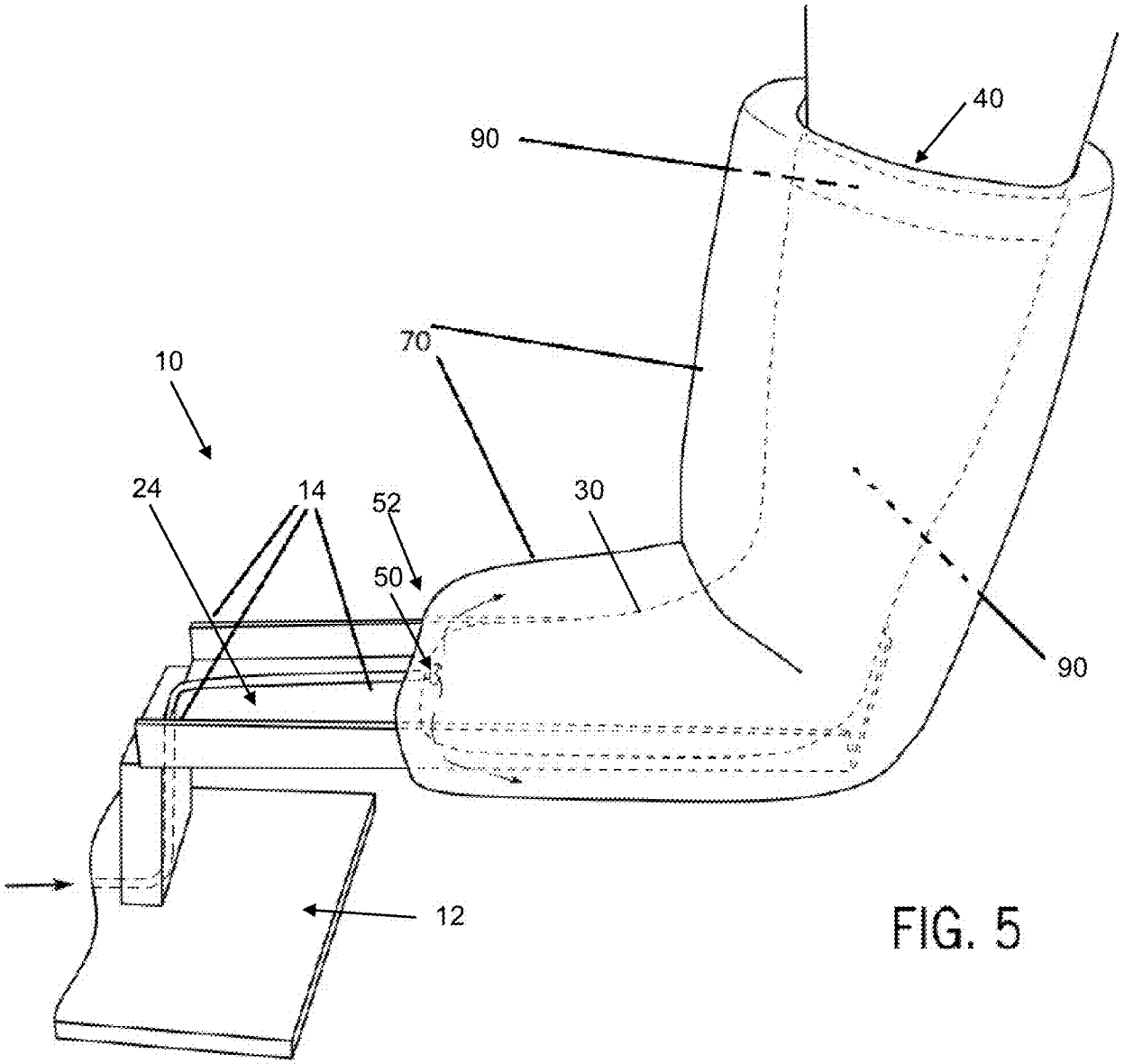
FIG. 5 is a perspective view of the apparatus as the bladder has sufficiently expanded to fully don the compression garment.
Figure 6:
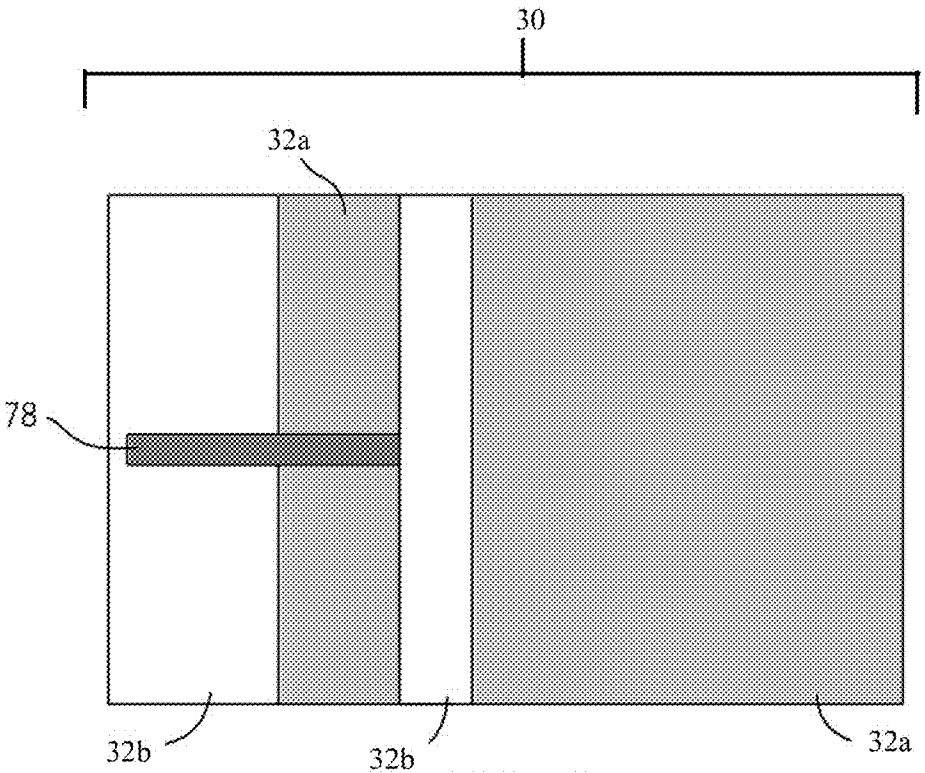
FIG. 6 is an exploded diagram of the splayed open bladder showing examples of the internal components and the stretch/non-stretch potential proportions and shapes.
Figure 7:
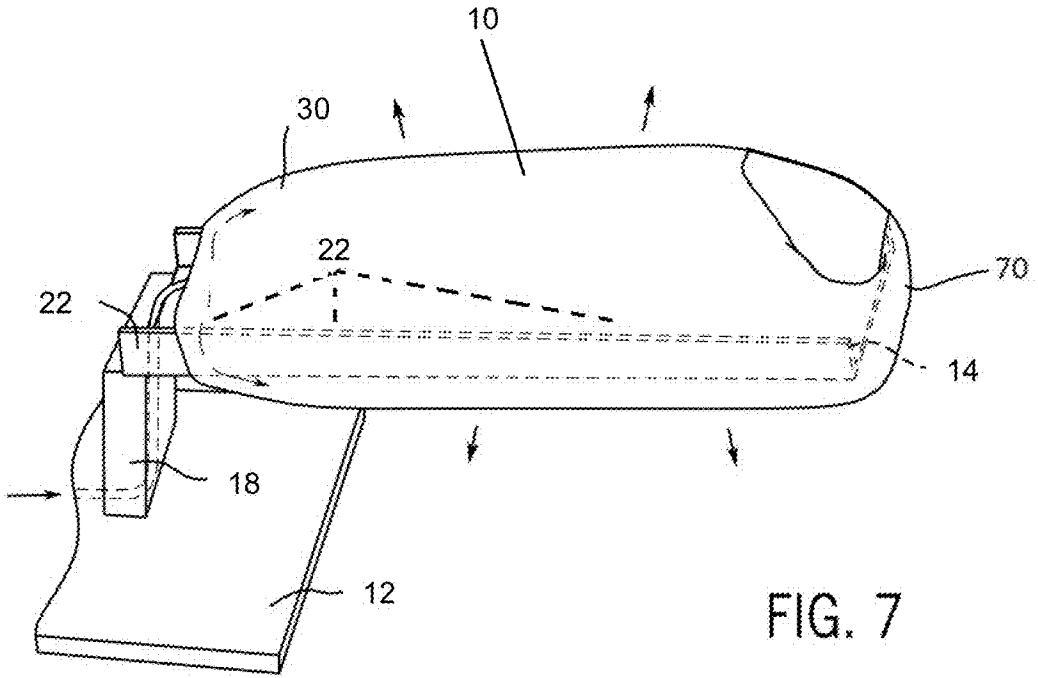
FIG. 7 is a perspective view of the apparatus with the bladder partially inflated and the compression garment omitted.

In some aspects, the bladder 30 can be coupled (optionally, fixedly coupled) to the platform 14. For example, the bladder 30 can be coupled to the platform at a distal location from the stand 18. In this way, as shown in FIGS. 3-5, the bladder 30 can be moved along the platform 14 so that a second rolled end 52 of the bladder 30 can move toward a distal end of the platform 14 to move the garment along the appendage of the user. That is, under pressure within the bladder 30 and/or pulling of the user, the bladder can move (e.g., via rolling) relative to the platform. It is contemplated that the bladder 30 can be coupled to the platform 14 using any suitable arrangement. For example, in some optional aspects, the bladder 30 can be coupled to the platform through mechanical (e.g., surface-to-surface or frictional) engagement. In other optional aspects, the bladder 30 can be coupled to the platform through adhesive, one or more fasteners, thermal bonding, combinations thereof, or other suitable arrangement or connection.

A system 10 can comprise the apparatus 10 and a compressed air source 110 in fluid communication with the inlet port 50. For example, tubing 112 can extend between the inlet port 50 and the compressed air source 110. In some aspects, the compressed air source 110 can be a pump. In other aspects, the compressed air source 110 can be a compressed air canister or a compressed air port, such as those in hospitals and medical facilities.

The apparatus can further comprise a structured foam 78 (e.g., semi-rigid foam) that can provide shape to the bladder as the bladder moves over the appendage (e.g., the foot). For example, the structured foam can provide structure to the bladder at the ankle to urge the bladder around the ankle and upwardly along the calf.

Referring to FIGS. 3-5, as air is injected into the bladder 30, the bladder can inflate, expanding against the compression stocking 90. The compression stocking can extend along only a portion 70 of a length of the bladder. The portion 70 of the length of the bladder that the compression stocking extends over can be more compressed than a portion 72 of the bladder that is outside of the stocking because of the pressure applied by the compression stocking (e.g., between 7 mmHG to 35 mmHG depending on the type of compression stocking). Accordingly, the hollow cylinder bladder can rotate forwardly due to the pressure on portion 72 that has less compression than the portion 70. The portion 70 of the hollow cylinder bladder that has the compression stocking 90 over it can rotate onto a foot 2, placing the compression onto the foot. The bladder 30 can further inflate and rotate forward past the toes 4 and dorsum 6 of the foot to the ankle joint and come into contact with the talus/tibia and the shin. The structured foam on the inside of the bladder 30 can maintain the integrity of the structure as the force on the bladder is a horizontal pushing force powered by pneumatic pressure. The portion 72 of the bladder 30 that does not have the compression stocking 90 over it can expand due to the unequal pressure. As the bladder expands, the bladder can rotate over the foot to push the compression stocking 90. Non-stretch patterns sewn into the bladder can help control the way the bladder inflates. Acute scalene triangle patterned and vertical bands are examples of these controls. Once the bladder is fully rotated forward, the compression stocking can be fully applied to the user. The pneumatic pressure can be released, and the user can remove the appendage from the bladder. The user can then rotate the hollow cylinder bladder back over the platform, setting up the apparatus back to the beginning of the cycle.

Exemplary Operation

Referring to FIGS. 1-5, the toe of the stocking can be inserted into the receiving space of the bladder, and the rest of the stocking can be pulled around the exterior of the bladder. The user's foot 2 can be positioned in front of the platform, with her toes 4 engaging the inverted toe of the stocking. The foot can be angled with the heel slightly elevated higher than the toes, matching the angle of the platform. To begin the operation, the bladder carrier can be fully retracted around the rigid bladder arm so that the toe portion of the stocking and the user's toes align at the start of operations.

Figure 2:
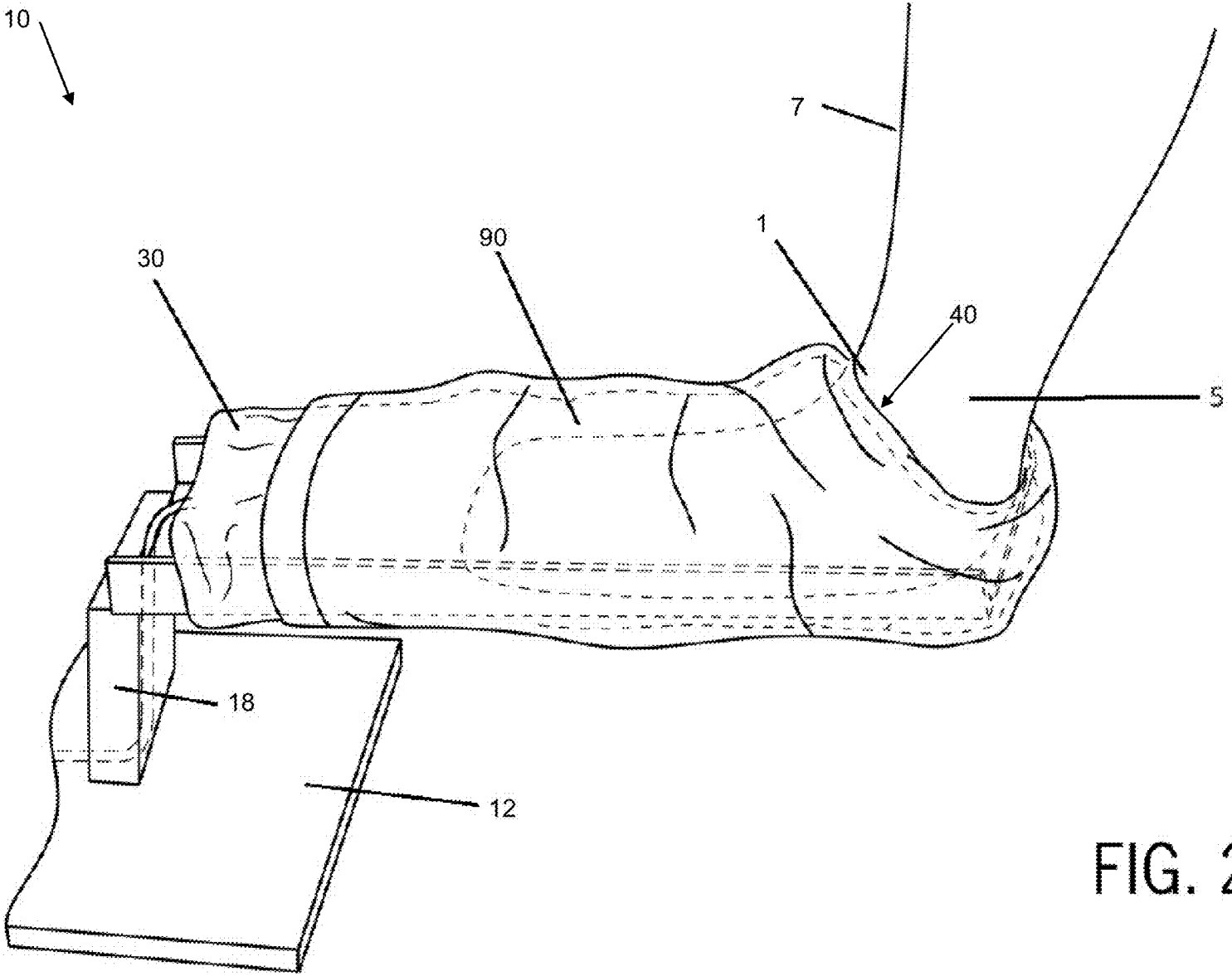
FIG. 2 is a perspective view of the apparatus of FIG. 1, in which a user has placed a foot within the compression garment.

As shown in FIG. 2, at the start of operation, the user's toes can be inserted into the toe of the stocking. The user can further slide the foot into the stocking until the stocking is rolled over the toes, the sole, and foot.

Referring to FIG. 3, the bladder can then be inflated, with the elastic distal end expanding, causing it to advance towards the smaller proximal end to force the bladder and stocking forwards as detailed in the hollow cylinder bladder section.

As shown in FIG. 4, as the bladder expands, both the stocking and bladder can move around the ankle 5.

Referring to FIG. 5, the bladder can rotate forwardly up the user's calf 7, fully donning the sock, with an upper end 94 of the stocking 90 against the leg. The bladder can then be deflated, allowing the user to remove their foot.

The disclosed apparatus can be particularly advantageous for a lymphedema patient. Those with lymphedema or edema in general have taut skin that is more prone to wounds. Skin that is edemas is taut and more easily damaged because of the tension on the skin. Areas on the body that are edemas heal more slowly. This is often a cycle of injury for patients with edema/lymphedema because compression is a regular part of the wound care. The automatic inflatable donner can to reduce hard components around any contact with the skin to reduce shearing or pressure wounds. This is another way the disclosed apparatus differs from the conventional donner devices. Such devices have hard rigid parts that are pulled across the body, adding the shearing/pressure force to already fragile skin. The low pressure required to inflate the device does not damage the skin or create wounds. The disclosed apparatus reduces the strength, coordination and reach required with more traditional donners.

Those skilled in the art will recognize, or be able to ascertain using no more than routine experimentation, many equivalents to the specific embodiments of the method and compositions described herein. Such equivalents are intended to be encompassed by the following claims.

What is claimed is:

1. An apparatus for donning a compression garment, the apparatus comprising:

a base comprising a platform extending along a longitudinal axis;

a bladder having a wall defining an inner surface and an outer surface, wherein the inner surface defines an interior volume, and wherein the wall is folded upon itself along a rolled end so that a first portion of the wall is surrounded by a second portion of the wall; and an inlet port in fluid communication with the interior volume of the bladder, wherein the outer surface of the first portion of the wall defines a receiving space positioned within and surrounded by the outer surface of the first portion, wherein the receiving space is configured to receive a portion of the compression garment, and wherein at least a portion of the bladder is movable relative to the platform to permit the rolled end to change position along the wall of the bladder.

2. The apparatus of claim 1, wherein the base further comprises a stand that is configured to rest on a surface, wherein the stand is coupled to the platform so that the stand supports the platform above the surface.

3. The apparatus of claim 2, wherein a portion of the bladder is fixedly coupled to the platform at a location spaced from the stand.

4. The apparatus of claim 1, wherein at least a portion of the wall of the bladder is configured to elongate.

5. The apparatus of claim 4, wherein the wall comprises a first material that is configured for elastic elongation and a second material that is resistant to elongation.

6. The apparatus of claim 4, wherein the first portion of the wall of the bladder is configured to resist elongation, and wherein the at least a portion of the wall of the bladder that is configured to elongate comprises the second portion, wherein the second portion of the wall is configured to elongate in response to adding fluid to the bladder, while the first portion of the wall is not configured to elongate in response to adding fluid to the bladder.

7. The apparatus of claim 6, wherein the first portion of the wall of the bladder comprises a non-stretch material to inhibit elongation.

8. The apparatus of claim 7, wherein the non-stretch material comprises non-stretch bands.

9. The apparatus of claim 8, wherein the non-stretch bands comprise metal or polymer.

10. The apparatus of claim 7, wherein the non-stretch material comprises a non-stretch cylinder that is configured to direct substantially all inflation force forward until the bladder inflates past an end of the non-stretch cylinder.

11. The apparatus of claim 6, wherein at least some areas of the wall of the bladder comprise a pattern of scalene triangles sewn into the wall of the bladder, wherein at least some other areas of the wall of the bladder do not comprise the pattern of scalene triangles, and wherein the areas of the bladder comprising the pattern of scalene triangles are configured to inflate, via the bladder, at a different rate from said other areas of the wall of the bladder that do not comprise the pattern of scalene triangles.

12. The apparatus of claim 11, wherein the pattern of scalene triangles is configured to translate horizontal inflation force to a vertical inflation force.

13. The apparatus of claim 1, wherein the bladder is coupled to the platform.

14. The apparatus of claim 1, wherein the platform comprises an upper surface and a pair of spaced longitudinally extending side walls that extend upwardly from the upper surface, wherein the upper surface and the pair of spaced longitudinally extending side walls cooperate to define a channel.

15. A system comprising:

an apparatus as in claim 1; and a compressed air source in fluid communication with the inlet port.

16. The system of claim 15, wherein the compressed air source is a pump.

17. A method of using the apparatus of claim 1, the method comprising:

inserting a first portion of a compression garment into the receiving space defined by the outer surface of the first portion of the wall;

folding the compression garment outwardly around the rolled end of the bladder so that a second portion of the compression garment is positioned over the outer surface of the second portion of the wall;

inserting an appendage into the first portion of the compression garment; and inflating the bladder.

18. The method of claim 17, wherein inflating the bladder causes the rolled end of the bladder to change position along the wall of the bladder.

19. The method of claim 17, wherein the compression garment is a compression sock, and wherein the appendage is a foot.

20. The method of claim 17, wherein the first portion of the wall of the bladder is configured to resist elongation, and wherein the at least a portion of the wall of the bladder that is configured to elongate comprises the second portion, wherein the second portion of the wall is configured to elongate in response to inflation of the bladder, while the first portion of the wall is not configured to elongate in response to inflation of the bladder.

* * * * *